US007034764B2

(12) United States Patent
Fukushima

(10) Patent No.: US 7,034,764 B2
(45) Date of Patent: Apr. 25, 2006

(54) ANTENNA DEVICE

(75) Inventor: Susumu Fukushima, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 24 days.

(21) Appl. No.: 10/493,812

(22) PCT Filed: Oct. 2, 2003

(86) PCT No.: PCT/JP03/12643

§ 371 (c)(1),
(2), (4) Date: Apr. 27, 2004

(87) PCT Pub. No.: WO2004/032282

PCT Pub. Date: Apr. 15, 2004

(65) Prior Publication Data

US 2004/0257287 A1 Dec. 23, 2004

(30) Foreign Application Priority Data

Mar. 10, 2002 (JP) ..... 2002-290906

(51) Int. Cl.
*H01Q 13/10* (2006.01)

(52) U.S. Cl. ..... 343/770; 343/908; 343/700 MS; 343/746

(58) Field of Classification Search ..... 343/770, 343/722, 746, 750, 751, 767, 844, 893, 908, 343/700 MS
See application file for complete search history.

(56) References Cited

U.S. PATENT DOCUMENTS

| | | | | |
|---|---|---|---|---|
| 4,242,685 | A * | 12/1980 | Sanford | 343/770 |
| 4,538,153 | A | 8/1985 | Taga | 343/700 MS |
| 4,803,494 | A * | 2/1989 | Norris et al. | 343/770 |
| 5,287,116 | A * | 2/1994 | Iwasaki et al. | 343/700 MS |
| 5,406,292 | A * | 4/1995 | Schnetzer et al. | 343/700 MS |
| 5,661,494 | A * | 8/1997 | Bondyopadhyay | 343/700 MS |
| 6,181,277 | B1 * | 1/2001 | Kesler et al. | 343/700 MS |
| 6,239,750 | B1 * | 5/2001 | Snygg | 343/700 MS |
| 6,295,030 | B1 | 9/2001 | Kozakai et al. | 343/700 MS |
| 6,507,320 | B1 * | 1/2003 | Von Stein et al. | 343/770 |
| 6,549,166 | B1 * | 4/2003 | Bhattacharyya et al. | 343/700 MS |

FOREIGN PATENT DOCUMENTS

| | | | |
|---|---|---|---|
| EP | 1 209 760 | 5/2002 | |
| JP | 58-215808 | 12/1983 | |
| JP | 60-40203 | 9/1985 | |
| JP | 61-143315 | 9/1986 | |
| JP | 5-347509 | 12/1993 | |
| JP | 7-14714 | 3/1995 | 343/702 |
| JP | 8-186427 | 7/1996 | |
| JP | 10-247818 | 9/1998 | |
| JP | 2001-332920 | 11/2001 | |
| JP | 3258819 | 12/2001 | |
| WO | 01/24316 | 4/2001 | |

* cited by examiner

*Primary Examiner*—Trinh V. Dinh
*Assistant Examiner*—Marie Antoinette Cabucos
(74) *Attorney, Agent, or Firm*—Wenderoth, Lind & Ponack, L.L.P.

(57) ABSTRACT

An antenna device has a circular radiation plate with a diameter of substantially ½ wavelength in electric length faced to a ground plate with a first power supply port and a second power supply port in its periphery. The power supply ports are disposed at positions where straight lines connecting respective power supply ports to a midpoint of the radiation plate intersect at right angles. Four slits axisymmetric with respect the straight lines are disposed in radiation plate, and two sides of the periphery of each slit contact with each other.

40 Claims, 12 Drawing Sheets

ANTENNA DEVICE

This application is a 371 of PCT/JP03/12643 filed on Oct. 02, 2003.

TECHNICAL FIELD

The present invention relates to an antenna device used mainly for mobile communications.

BACKGROUND ART

A communication module allowing use of a plurality of information communication systems is shown in FIG. 12. Communication module 100 of FIG. 12 allows use of both Bluetooth system 103 having antenna 101 and wireless-local area network (W-LAN) system 104 having antenna 102. In communication module 100, a problem occurs in a case in which both systems 103 and 104 employ the same frequency band of 2.4 GHz and are simultaneously operated. When one system transmits a signal while the other system lies in a receiving state, the signal of the former system disturbs the latter system to cause extreme reduction of bit error rate (BER).

Conventional art related to the present invention is disclosed in Japanese Patent No. 3114582 or Japanese Patent Unexamined Publication No. 2001-177330, for example.

In the structure discussed above, two antennas 101 and 102 must be disposed physically separately, so that the size of a housing for storing communication module 100 consequentially increases. Two antennas 101 and 102 require two mounted positions and double manufacturing cost.

SUMMARY OF THE INVENTION

The present invention provides an antenna device having a ground plate, a radiation plate faced to the ground plate, and a plurality of power supply ports in a region having zero electric potential on the radiation plate. The radiation plate has four slits axisymmetric with respect to a first straight line group for connecting respective power supply ports to the midpoint of the radiation plate. A second straight line group orthogonal to the first straight line group substantially contacts with two sides of each slit at an arbitrary point between an end of the radiation plate and the midpoint of the radiation plate.

DETAILED DESCRIPTION OF PREFERRED EMBODIMENTS

EXEMPLARY EMBODIMENT 1

Figure 1A:
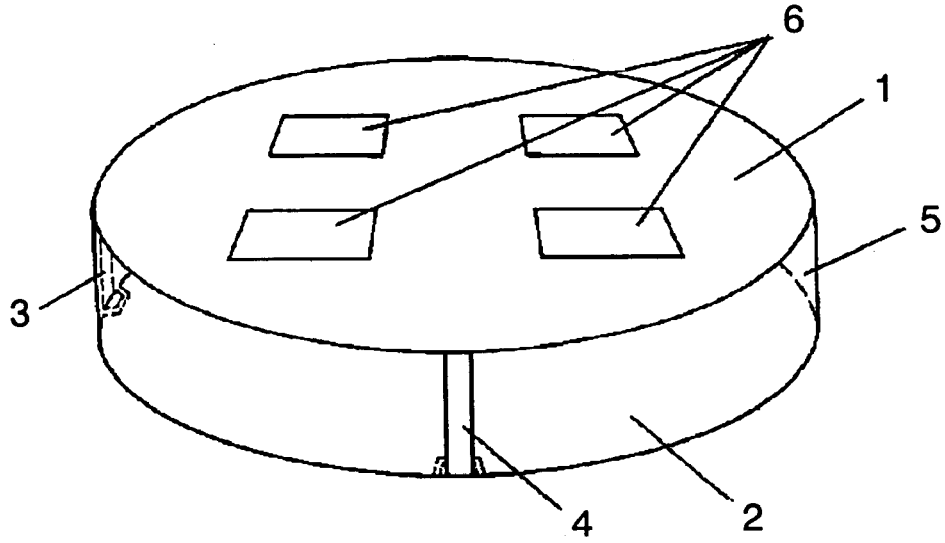
FIG. 1A is a perspective view of an antenna device in accordance with exemplary embodiment 1 of the present invention.
Figure 1B:
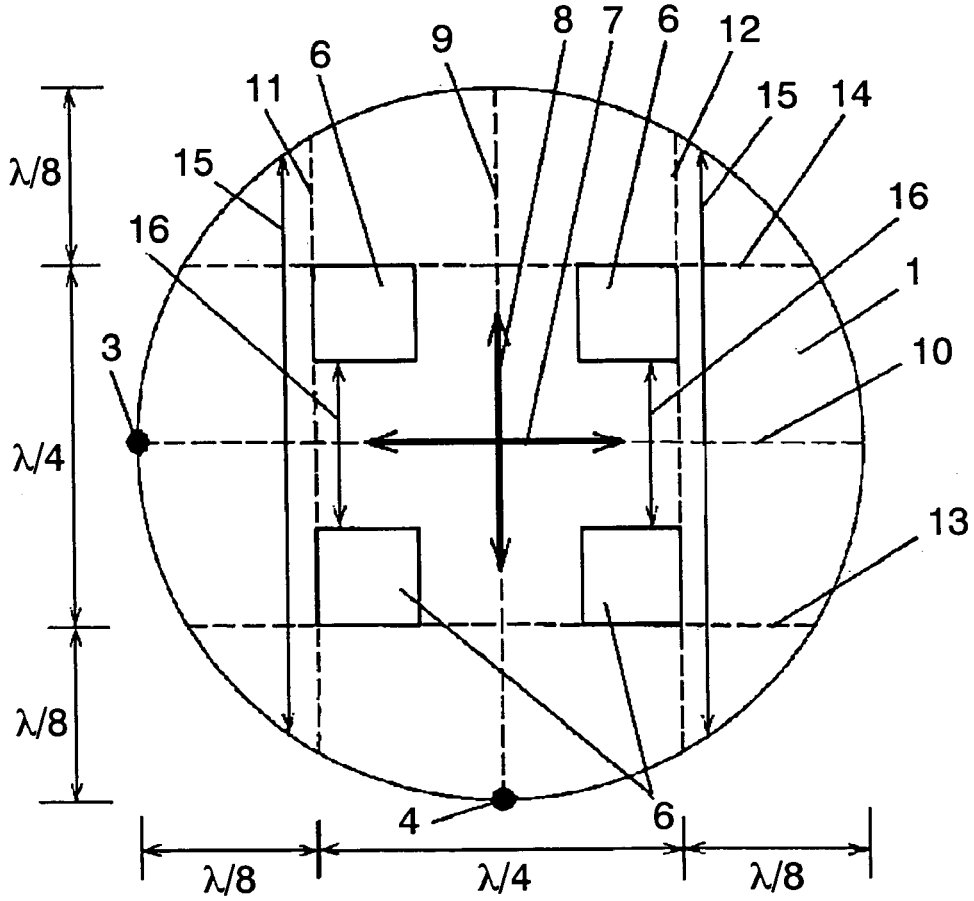
FIG. 1B is a top view of the antenna device in accordance with exemplary embodiment 1.

FIG. 1A and FIG. 1B show an antenna device in accordance with exemplary embodiment 1 of the present invention. In the antenna device of FIG. 1A, a plurality of power supply ports, namely first power supply port 3 and second power supply port 4, are disposed in the periphery of radiation plate 1 faced to ground plate 2. First substrate 5 is disposed between radiation plate 1 and ground plate 2. First straight line 9 connects the midpoint of radiation plate 1 to first power supply port 3, second straight line 10 connects the midpoint to second power supply port 4, and these straight lines constitute a first straight line group. Third straight line 11 and fourth straight line 12 intersect second straight line 10 at right angles at points ⅛ wavelength (electric length) away from the peripheral points of radiation plate 1 on second straight line 10. Fifth straight line 13 and sixth straight line 14 intersect first straight line 9 at right angles at points ⅛ wavelength (electric length) away from the peripheral points of radiation plate 1 on first straight line 9. Straight lines 11, 12, 13, and 14 constitute a second straight line group. Slits 6 are disposed on radiation plate 1, and two sides of each slit 6 substantially contact with two of straight lines 11, 12, 13, and 14. Positions and shapes of slits 6 are symmetric with respect to the midpoint of radiation plate 1.

FIG. 1B shows the size of radiation plate 1 of the antenna device having two power supply ports 3 and 4 shown in FIG.

1A, and positions of power supply ports 3 and 4. Radiation plate 1 has a circular shape having a diameter equal to a ½ wavelength (electric length) of a desired frequency, and has first and second power supply ports 3 and 4 in its periphery.

When a signal having the desired frequency is fed into only first power supply port 3, radiation plate 1 and ground plate 2 operate as a ½ wavelength resonator opening in the periphery on second straight line 10, and first resonance current 7 flows on radiation plate 1. As discussed above, second straight line 10 (first straight line group) connects first power supply port 3 to the midpoint of radiation plate 1. The ½ wavelength resonator opening in the periphery has zero electric potential at its midpoint (a point ¼ wavelength away from the end). In other words, electric potential on first straight line 9 (first straight line group) on radiation plate 1 is always zero. Second power supply port 4 is positioned on first straight line 9 having zero electric potential, so that a high frequency signal fed from first power supply port 3 does not leak to second power supply port 4.

Similarly, when a signal having the desired frequency is fed into only second power supply port 4, second resonance current 8 flows on radiation plate 1, and electric potential is always zero on second straight line 10 (first straight line group) on radiation plate 1. Therefore, a signal having the desired frequency fed from second power supply port 4 does not leak to first power supply port 3 positioned on second straight line 10. For realizing the characteristic discussed above, the positions of respective power supply ports are determined so that second straight line 10 intersects first straight line 9 at right angles at the midpoint of radiation plate 1. First straight line 9 (first straight line group) connects second power supply port 4 to the midpoint of radiation plate 1, as discussed above.

Line width of first straight line 9 is changed from first line width 15 to second line width 16 by disposing slits 6. Therefore, when radiation plate 1 and ground plate 2 are considered to form a resonator, characteristic impedance is lower in a region having large first line width 15, and characteristic impedance is higher in a region having narrow second line width 16. Varying the characteristic impedance between the radiation plate 1 and ground plate 2 can provide a stepped impedance resonator (SIR) structure and shorten resonator length, so that the antenna device can be downsized.

Line width is varied at a point ⅛ wavelength away from the periphery of radiation plate 1 in embodiment 1. That is because the resonator can be minimized when the characteristic impedance of the resonator is varied at the point ⅛ wavelength away from the end.

EXEMPLARY EMBODIMENT 2

Figure 2A:
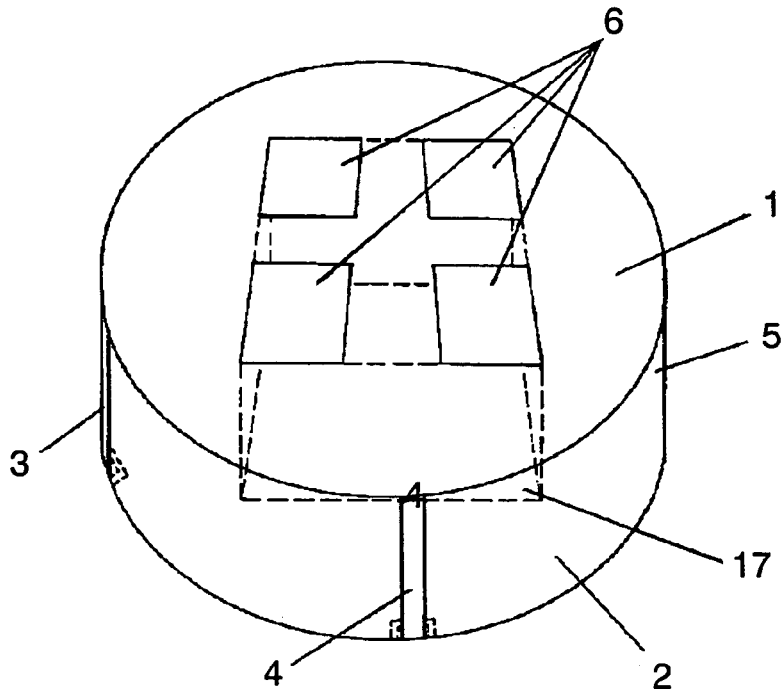
FIG. 2A is a perspective view of an antenna device in accordance with exemplary embodiment 2 of the present invention.
Figure 2B:
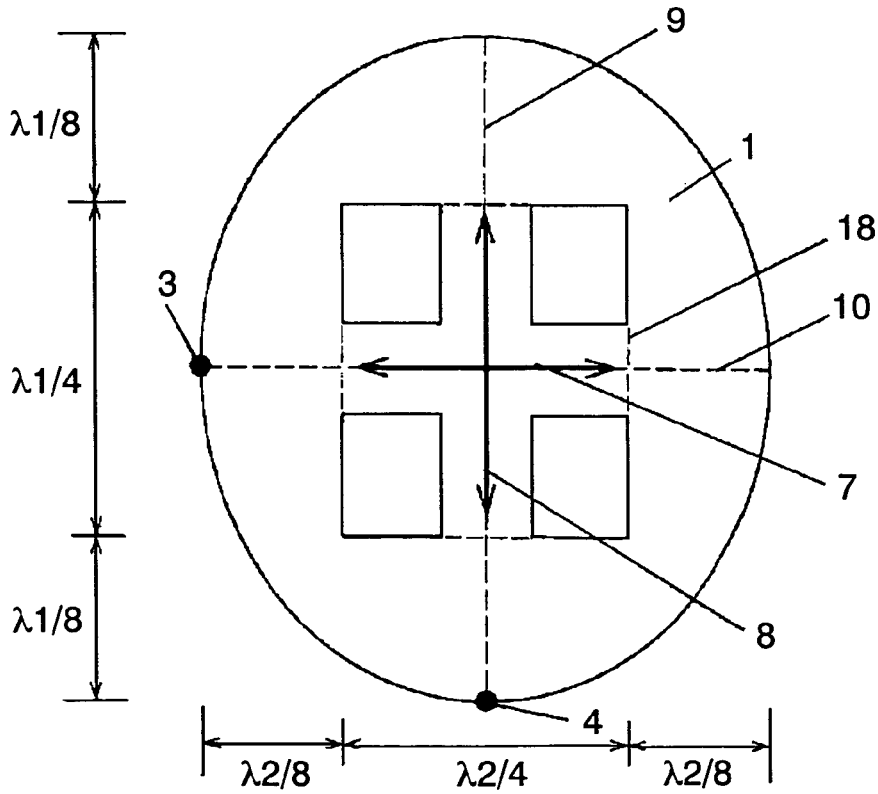
FIG. 2B is a top view of the antenna device in accordance with exemplary embodiment 2.

FIG. 2A and FIG. 2B show an antenna device in accordance with exemplary embodiment 2 of the present invention. In the antenna device of FIG. 2A and FIG. 2B, length of first straight line 9 (first straight line group) of embodiment 1 is set different from that of second straight line 10 (first straight line group). Boundary line 18 is formed of a second straight line group orthogonal to first straight line 9 and second straight line 10 at points ⅛ wavelengths (electric lengths $\lambda 1$ and $\lambda 2$) away from the periphery of radiation plate 1. The substrate between radiation plate 1 and ground plate 2 is changed from first substrate 5 to second substrate 17 at the boundary line 18. Substrates 5 and 17 are selected so that a value derived by dividing relative magnetic permeability of first substrate 5 by relative dielectric constant thereof is lower than that of second substrate 17.

Forming radiation plate 1 in an elliptical shape can make resonant frequency of first power supply port 3 different from that of second power supply port 4. In a using example of this antenna device, first power supply port 3 can be used for transmission of a global system for mobile communications (GSM), and second power supply port 4 can be used for reception. Isolation between both power supply ports 3 and 4 is secured in the antenna device itself, so that a shared apparatus need not be disposed just under the antenna device. This antenna device can be also used in response to two systems, so that first power supply port 3 can be used for W-LAN and second power supply port 4 can be used for Bluetooth, for example.

EXEMPLARY EMBODIMENT 3

Figure 3A:
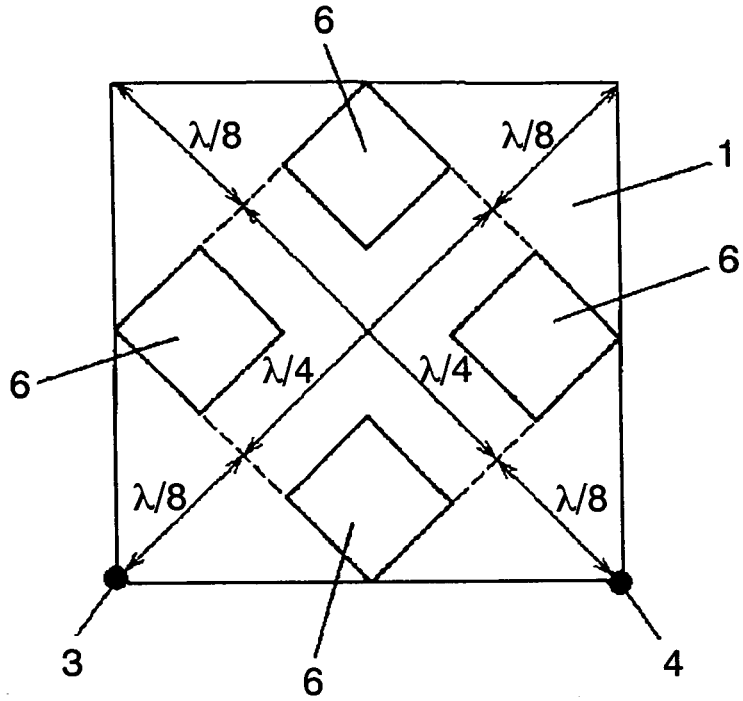
FIG. 3A is a top view of an antenna device in accordance with exemplary embodiment 3 of the present invention.
Figure 3B:
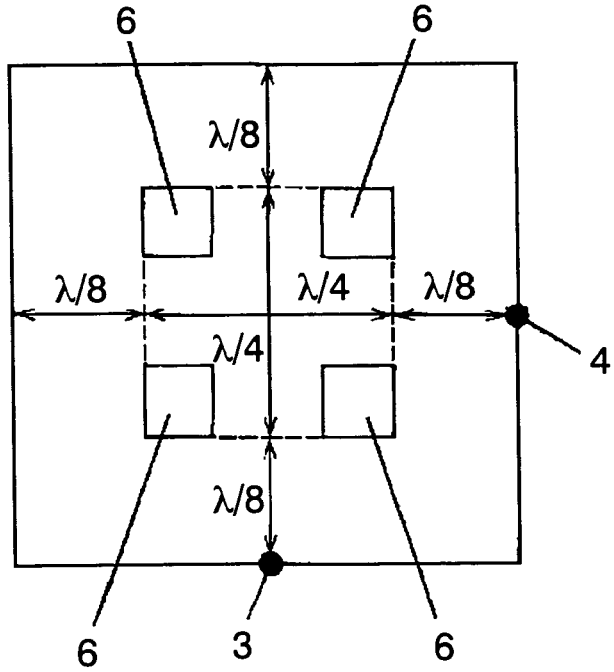
FIG. 3B is a top view of another antenna device in accordance with exemplary embodiment 3.

FIG. 3A and FIG. 3B show shapes of radiation plates 1 of antenna devices in accordance with exemplary embodiment 3 of the present invention. Radiation plates 1 of FIG. 3A and FIG. 3B have a square shape changed from the circular shape. In FIG. 3A, first power supply port 3 and second power supply port 4 are disposed on corners of radiation plate 1. In FIG. 3B, each of power supply ports 3 and 4 is the midpoint of each side of radiation plate 1.

EXEMPLARY EMBODIMENT 4

Figure 4A:
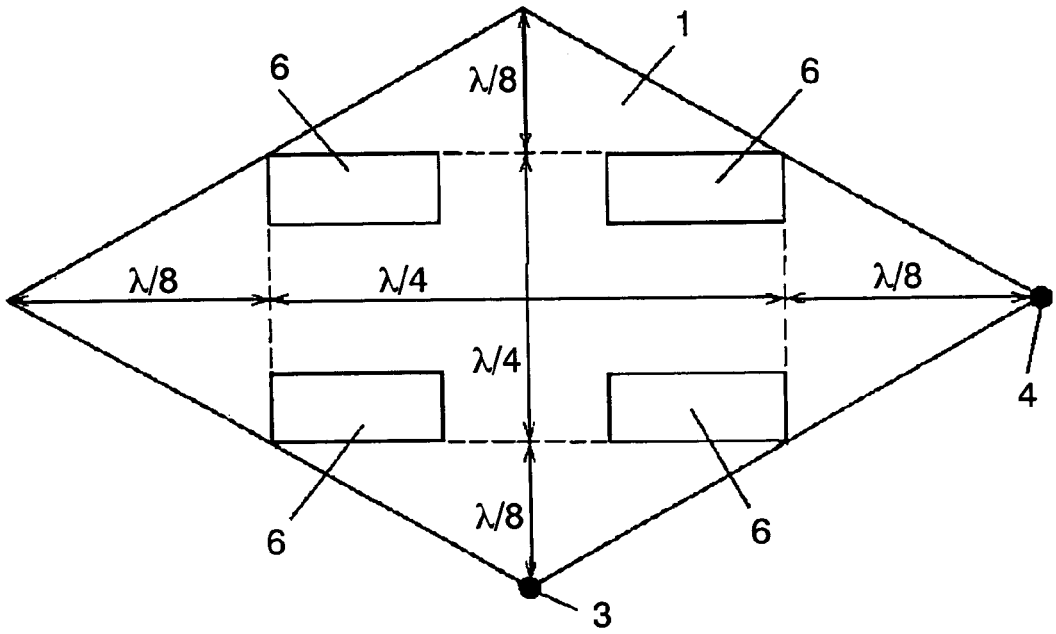
FIG. 4A is a top view of an antenna device in accordance with exemplary embodiment 4 of the present invention.
Figure 4B:
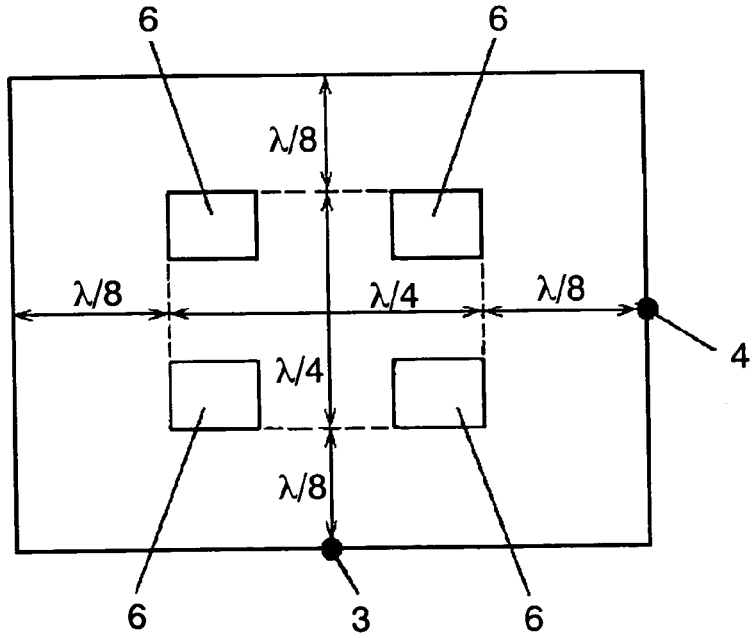
FIG. 4B is a top view of another antenna device in accordance with exemplary embodiment 4.

FIG. 4A and FIG. 4B show shapes of radiation plates 1 of antenna devices in accordance with exemplary embodiment 4 of the present invention. Radiation plates 1 of FIG. 4A and FIG. 4B have a rectangular shape changed from the elliptical shape. In FIG. 4A, first power supply port 3 and second power supply port 4 are disposed on corners of radiation plate 1. In FIG. 4B, each of power supply ports 3 and 4 is the midpoint of each side of radiation plate 1.

EXEMPLARY EMBODIMENT 5

Figure 5A:
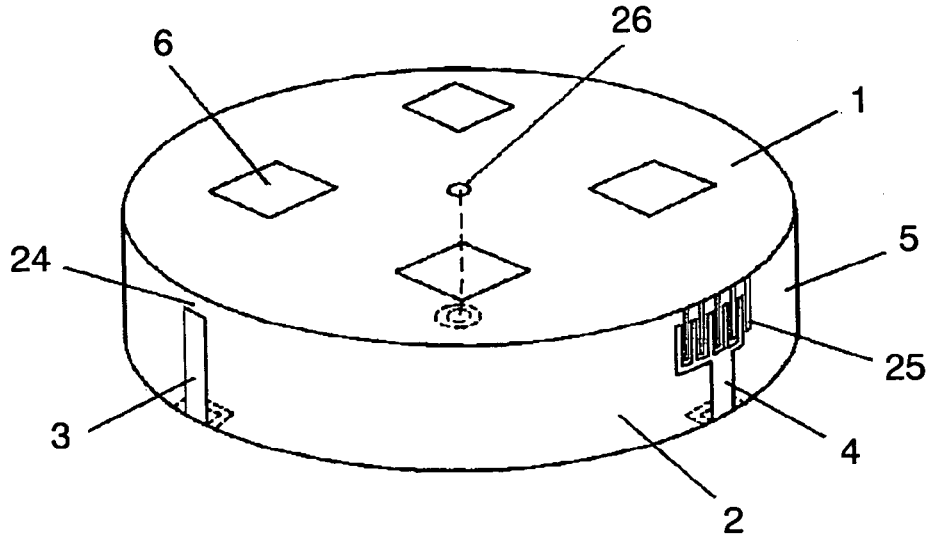
FIG. 5A is a perspective view of an antenna device in accordance with exemplary embodiment 5 of the present invention.
Figure 5B:
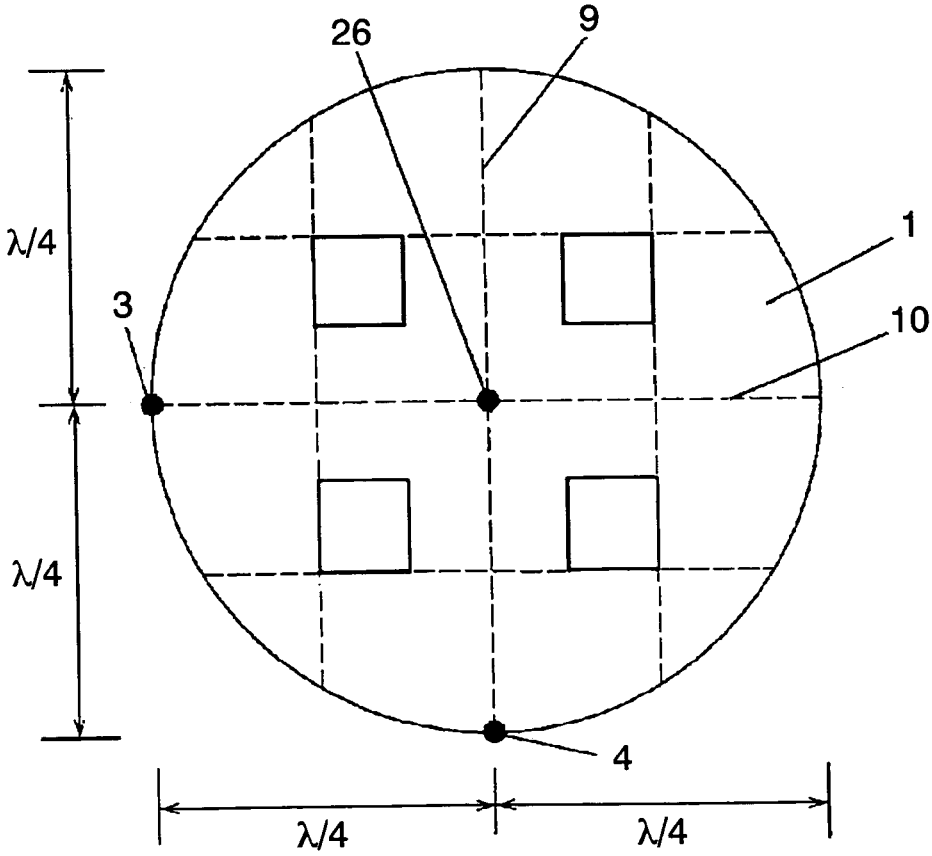
FIG. 5B is a top view of the antenna device in accordance with exemplary embodiment 5.

FIG. 5A and FIG. 5B show an antenna device in accordance with exemplary embodiment 5 of the present invention. This antenna device is formed by changing the shape of the connecting part between each of power supply ports 3 and 4 and radiation plate 1 of the antenna device of embodiment 1 and by forming third power supply port 26 in the center of radiation plate 1. Gap 24 is disposed between first power supply port 3 and radiation plate 1, and impedance matching between first power supply port 3 and radiation plate 1 is allowed by adjusting the interval and width of gap 24. Inter-digital structure 25 is formed between second power supply port 4 and radiation plate 1, so that capacity between second power supply port 4 and radiation plate 1 can be set large. Therefore, the adjustment range of impedance of second power supply port 4 can be increased.

As a result, by adjusting the interval of the gap, the antenna device can be aligned without using a matching circuit and cost and mounting space required for the matching circuit can be reduced.

Third power supply port 26 is disposed at the midpoint of radiation plate 1. That is because the midpoint of radiation plate 1 always has zero electric potential even when power is supplied to first power supply port 3 and second power supply port 4. In other words, on first straight line 9, the electric potential generated on radiation plate 1 when a signal having a desired frequency is supplied to only first power supply port 3 is always zero. On second straight line 10, the electric potential generated on radiation plate 1 when a signal having the desired frequency is supplied to only second power supply port 4 is always zero. First straight line 9 and second straight line 10 intersect at the midpoint of radiation plate 1.

A matching circuit for matching with radiation plate 1 is generally required to lie just under third power supply port 26, so that substrate 5 filled between radiation plate 1 and ground plate 2 is formed in a lamination structure and the matching circuit may be formed of substrate 5.

When frequency used in third power supply port 26 is set different from the frequency used in first power supply port 3 and second power supply port 4, isolation between third power supply port 26 and each of power supply ports 3 and 4 can be increased.

When the antenna device is used in consideration of the characteristics discussed above, for example, first power supply port 3 and second power supply port 4 are used as a polarization diversity antenna of the W-LAN, and third power supply port 26 is used as an antenna for a system employing a frequency other than 2.4 GHz band such as a television, a global positioning system (GPS), or a personal digital cellular (PDC).

EXEMPLARY EMBODIMENT 6

Figure 6A:
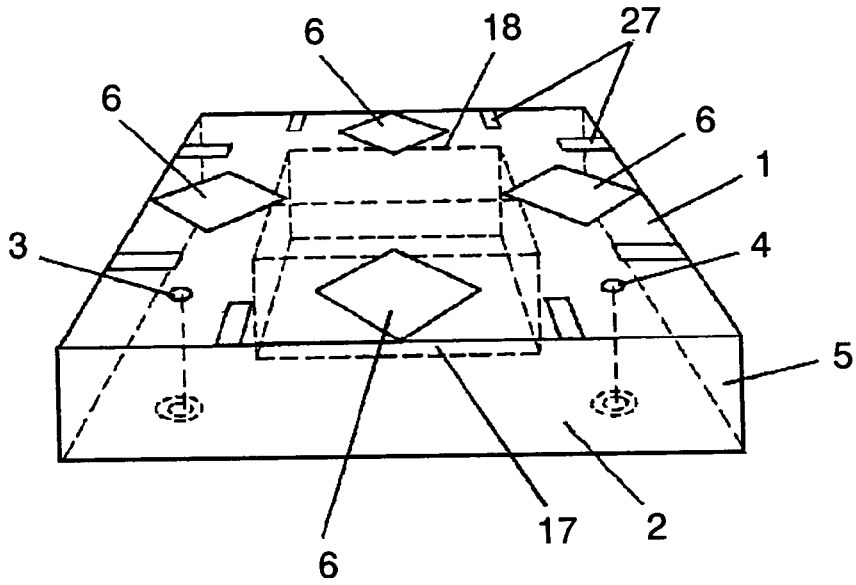
FIG. 6A is a perspective view of an antenna device in accordance with exemplary embodiment 6 of the present invention.
Figure 6B:
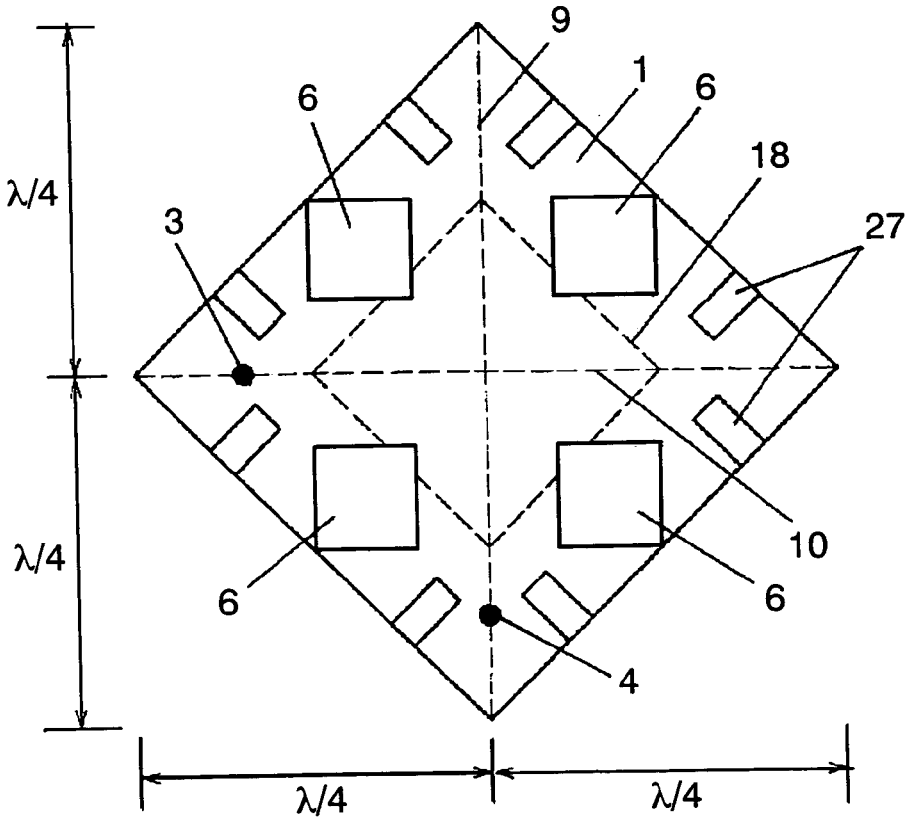
FIG. 6B is a top view of the antenna device in accordance with exemplary embodiment 6.

FIG. 6A and FIG. 6B show an antenna device in accordance with exemplary embodiment 6 of the present invention. In FIG. 6A, square radiation plate 1 where electric length of the diagonal lines is substantially ½ wavelength is faced to ground plate 2, and first substrate 5 and second substrate 17 are filled between radiation plate 1 and ground plate 2. Boundary line 18 between first substrate 5 and second substrate 17 is disposed in a place ⅛ wavelength (electric length) away from the periphery of radiation plate 1 toward the midpoint of radiation plate 1. The substrate is selected so that a value derived by dividing relative magnetic permeability of first substrate 5 by relative dielectric constant thereof is lower than that of second substrate 17.

Radiation plate 1 has four slits 6 symmetric with respect to the midpoint thereof. Two sides of the outer periphery of each slit 6 contact with respective straight lines orthogonal to the first straight line group connecting power supply ports to the midpoint of radiation plate 1, at points ⅛ wavelength (electric length) away from the periphery of radiation plate 1. First power supply port 3 and second power supply port 4 are disposed not in the periphery of radiation plate 1, but inside radiation plate 1. Power supply ports 3 and 4 are arranged so that first straight line 9 (first straight line group) connecting power supply port 3 to the midpoint of radiation plate 1 intersects second straight line 10 (first straight line group) connecting power supply port 4 to the midpoint at right angles at the midpoint of radiation plate 1. Each of power supply ports 3 and 4 is disposed at an arbitrary position on each of first and second straight lines 9 and 10, so that impedance matching of power supply ports 3 and 4 can be performed without using a matching circuit.

Notches 27 are formed in the periphery of radiation plate 1 so that radiation plate 1 is axisymmetric with respect to first straight line 9 and second straight line 10, thereby decreasing resonant frequency of the antenna device. As a result, the antenna device can be downsized.

Notches 27 are formed in the periphery of square radiation plate 1 in embodiment 6; however, a circular, regular polygonal, or quadrangular radiation plate can produce a similar advantage.

EXEMPLARY EMBODIMENT 7

Figure 7A:
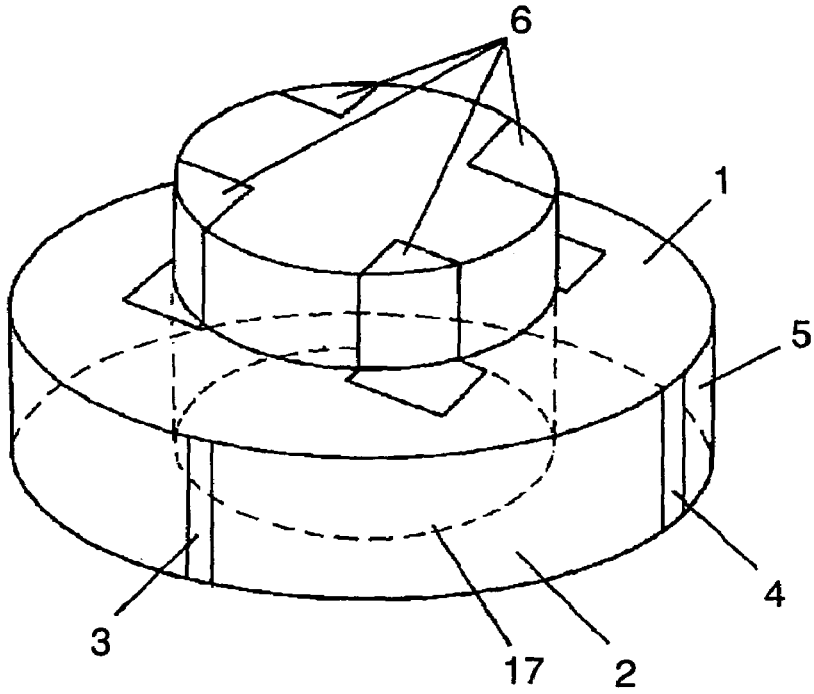
FIG. 7A is a perspective view of an antenna device in accordance with exemplary embodiment 7 of the present invention.
Figure 7B:
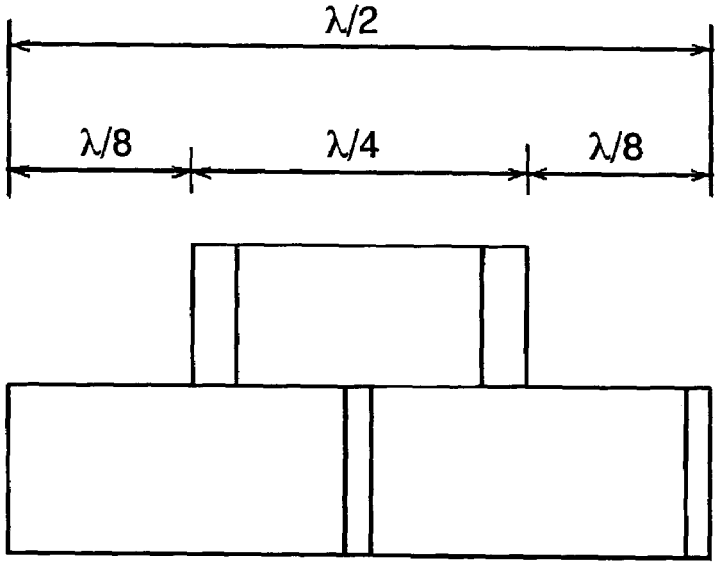
FIG. 7B is a side view of the antenna device in accordance with exemplary embodiment 7.

FIG. 7A and FIG. 7B show an antenna device in accordance with exemplary embodiment 7 of the present invention. In FIG. 7A and FIG. 7B, cylindrical second substrate 17 (diameter is ¼ wavelength in electric length) is made of dielectric material, magnetic material, or a mixture of them. Torus-shaped first substrate 5 (diameter is ½ wavelength in electric length) made of a component different from that of second substrate 17 is disposed around the second substrate 17. Radiation plate 1 is formed on the upper surface of first substrate 5 and the surface of second substrate 17. Here, the surface of second substrate 17 lies above the upper surface of first substrate 5. First power supply port 3 and second power supply port 4 are connected to the periphery of radiation plate 1. Each of power supply ports 3 and 4 is connected to a position where the straight lines of the first straight line group connecting respective power supply ports 3 and 4 to the midpoint of radiation plate 1 intersect at right angles.

Radiation plate 1 has four slits 6 symmetric with respect to the midpoint thereof. Two sides of the outer periphery of each slit 6 contact with the second straight line group orthogonal to the first straight line group, at points ⅛ wavelength (electric length) away from the periphery of radiation plate 1. Here, the first straight line group connects power supply ports 3 and 4 to the midpoint of radiation plate 1. The substrate is selected so that a value derived by dividing relative magnetic permeability of first substrate 5 by relative dielectric constant thereof is lower than that of second substrate 17.

Between radiation plate 1 and ground plate 2, characteristic impedance in the region filled with second substrate 17 can be larger than that in the region filled with second substrate 5. The interval (distance) between radiation plate 1 and ground plate 2 is larger in the region filled with second substrate 17 than in the region filled with second substrate 5, so that the antenna device structure can be designed so that the characteristic impedance in the region filled with second substrate 17 is large.

The present embodiment produces an advantage similar to that of embodiment 1 by forming four slits 6 in radiation plate 1. Therefore, on the first straight line group, the characteristic impedance in the region between the periphery of radiation plate 1 and the position ⅛ wavelength (electric length) away from the periphery can be set smaller than that in the other region. The first straight line group connects each of power supply ports 3 and 4 to the midpoint of radiation plate 1, discussed above.

In this antenna device structure, the characteristic impedance can be largely changed at the position ⅛ wavelength (electric length) away from the periphery of radiation plate 1, depending on the material, structure, and radiation plate shape. Therefore, the SIR structure can be realized and the antenna device can be downsized.

EXEMPLARY EMBODIMENT 8

Figure 8A:
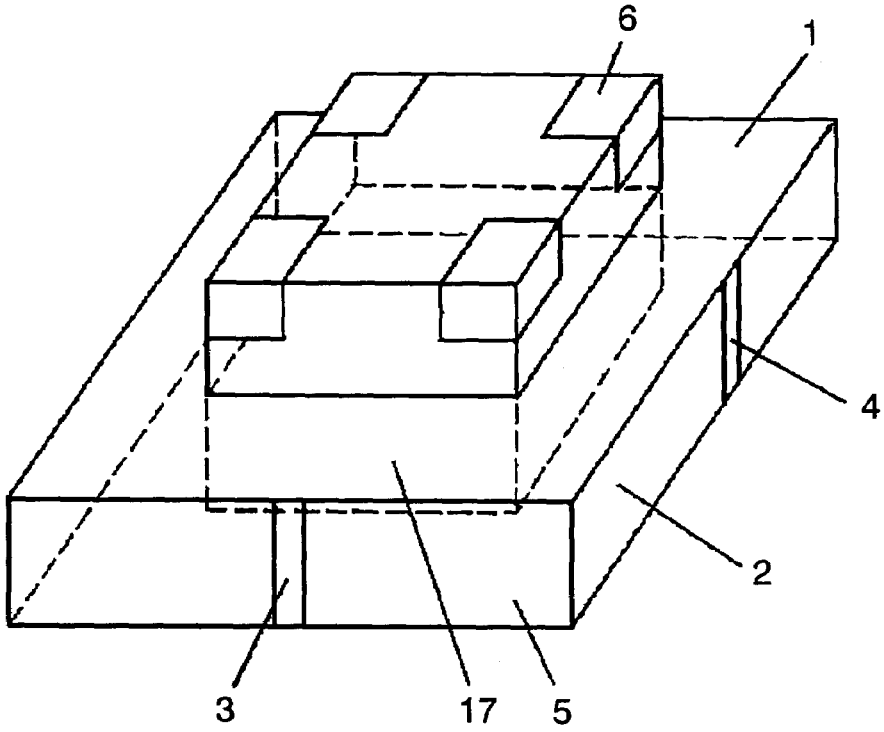
FIG. 8A is a perspective view of an antenna device in accordance with exemplary embodiment 8 of the present invention.
Figure 8B:
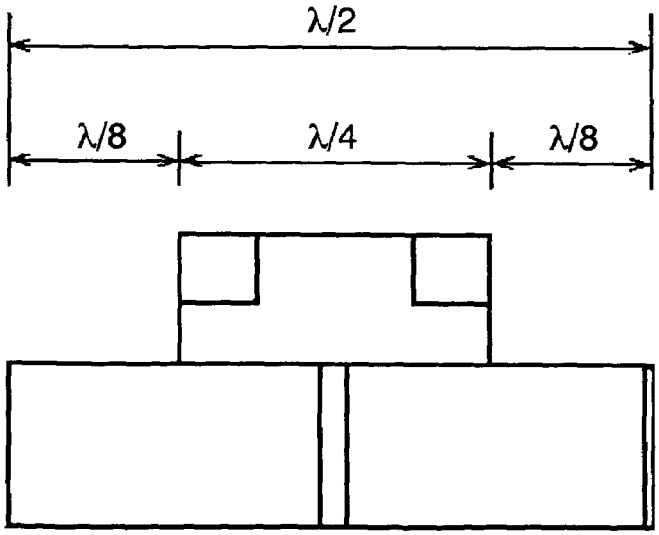
FIG. 8B is a side view of the antenna device in accordance with exemplary embodiment 8.

FIG. 8A and FIG. 8B show an antenna device in accordance with exemplary embodiment 8 of the present invention. Radiation plate 1 of this antenna device has a square shape. This square shape is obtained by changing the circular shape in radiation plate 1 of embodiment 7. Second substrate 17 has a square pole shape having a bottom of which each side has ¼ wavelength (electric length). Each slit 6 is shaped so as to contact with straight lines orthogonal to the first straight line group, at points ⅛ wavelength (electric length) away from the periphery of radiation plate 1. Here, the first straight line group connects power supply ports 3 and 4 to the midpoint of radiation plate 1. The characteristic of the antenna device of embodiment 8 can produce advantage similar to that of embodiment 7. Either of radiation plate 1 having the circular outer shape and radiation plate 1 having the square outer shape is axisymmetric with respect to the first straight line group which connects power supply ports 3 and 4 to the midpoint of the upper surface of second substrate 17. Either of radiation plates 1 therefore has a similar characteristic.

An arbitrary number of slits are disposed in arbitrary positions of the periphery of the radiation plate axisymmetric with respect to the first straight line group, so that the radiation plate can be designed to have equivalently long electric length thanks to the slits. As a result, the antenna device can be downsized.

EXEMPLARY EMBODIMENT 9

Figure 9:
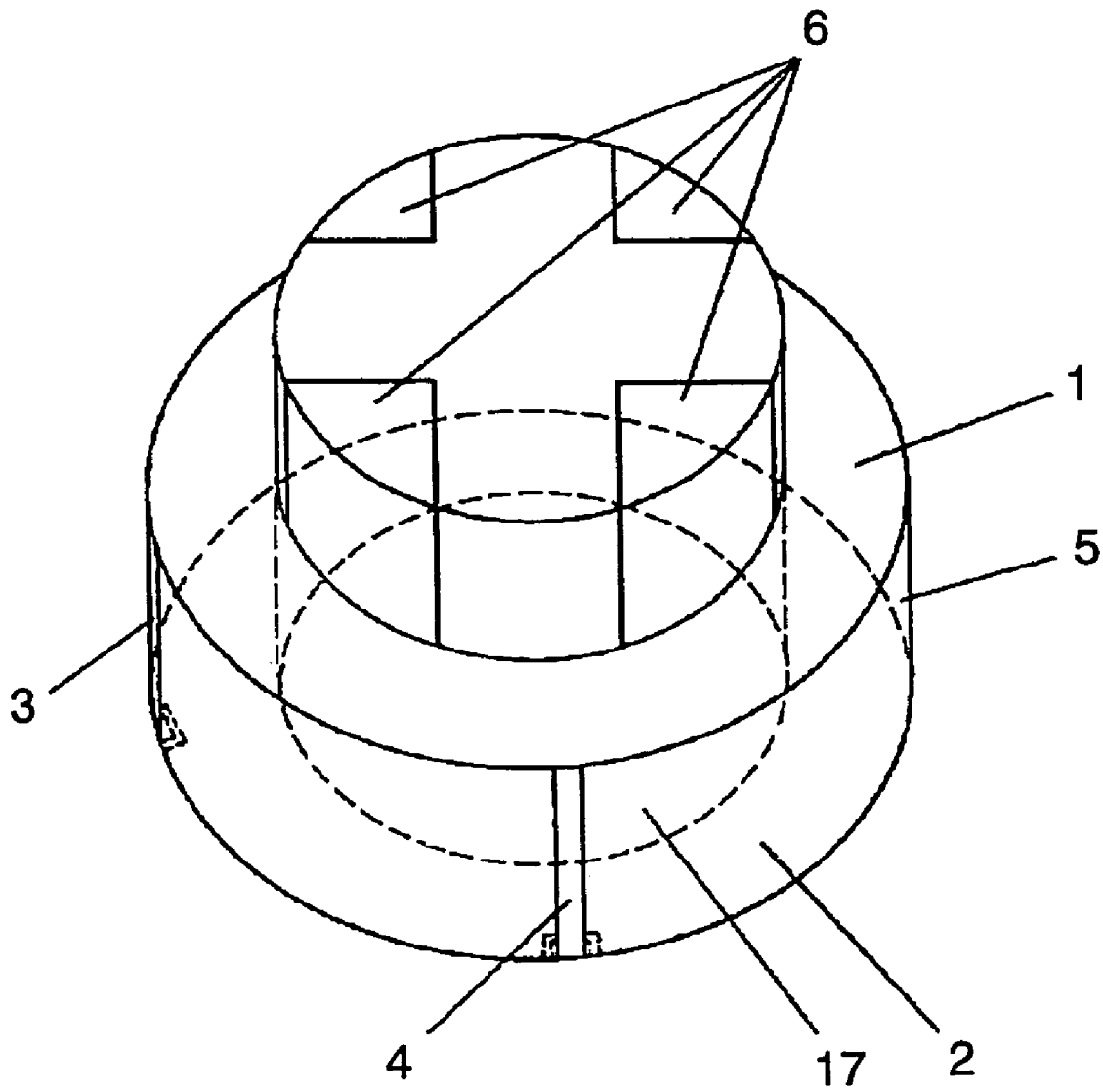
FIG. 9 is a perspective view of an antenna device in accordance with exemplary embodiment 9 of the present invention.

FIG. 9 shows an antenna device in accordance with exemplary embodiment 9 of the present invention. This antenna device has a structure similar to that of the antenna device of embodiment 7, but length of the first straight line group which connects first power supply port 3 to the midpoint of the upper surface of second substrate 17 is set different from that of the first straight line group which connects second power supply port 4 to the midpoint. This structure allows realization of a small antenna device where resonant frequency of first power supply port 3 is different from that of second power supply port 4.

EXEMPLARY EMBODIMENT 10

Figure 10A:
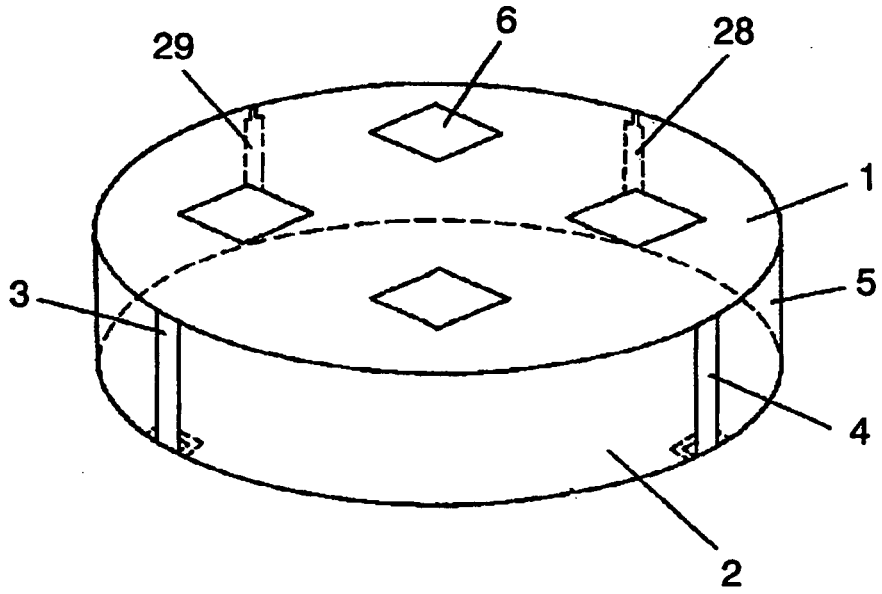
FIG. 10A is a perspective view of an antenna device in accordance with exemplary embodiment 10 of the present invention.
Figure 10B:
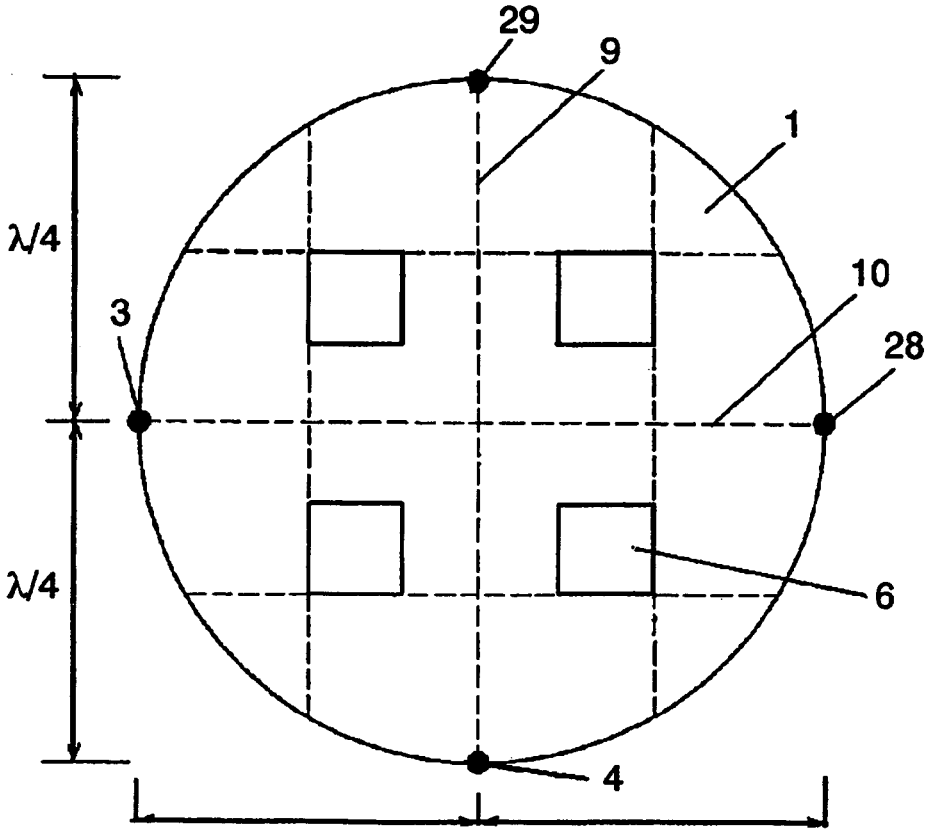
FIG. 10B is a top view of the antenna device in accordance with exemplary embodiment 10.

FIG. 10A and FIG. 10B show an antenna device in accordance with exemplary embodiment 10 of the present invention. This antenna device has a structure similar to that of the antenna device of embodiment 1. In the antenna device of embodiment 10, one end of first reactance element 28 is electrically connected to the peripheral point of radiation plate 1 that is symmetric to the position of first power supply port 3 with respect to the midpoint of radiation plate 1. Second reactance element 29 is electrically connected to the peripheral point of radiation plate 1 that is symmetric to the position of second power supply port 4 with respect to the midpoint of radiation plate 1.

Reactance elements 28 and 29 allow electric length to be extended in supplying power to each of power supply ports 3 and 4, so that the antenna device can be downsized. Impedance of the antenna device can be adjusted by polishing and adjusting the shapes of reactance elements 28 and 29. When the other end of each of reactance elements 28 and 29 that is not connected to radiation plate 1 is connected to ground plate 2, a similar advantage can also be produced.

The isolation between ports in the antenna device is adjusted by cutting the periphery of the opening tip of the reactance element. The characteristic of the antenna device varies depending on a mounted housing, but can be adjusted by adjusting length of a conductive element having an opening tip. Therefore, the antenna device can rapidly correspond to various housings.

EXEMPLARY EMBODIMENT 11

Figure 11A:
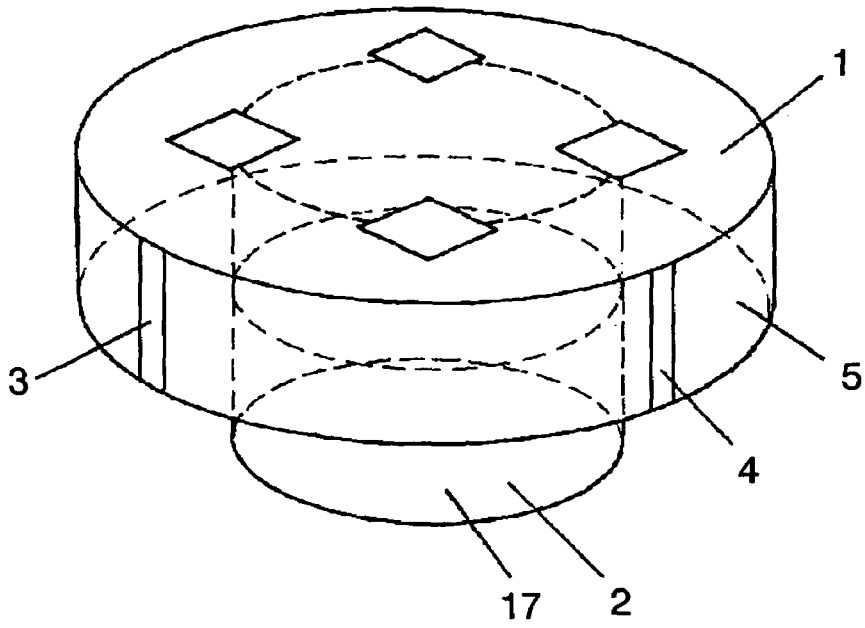
FIG. 11A is a perspective view of an antenna device in accordance with exemplary embodiment 11 of the present invention.
Figure 11B:
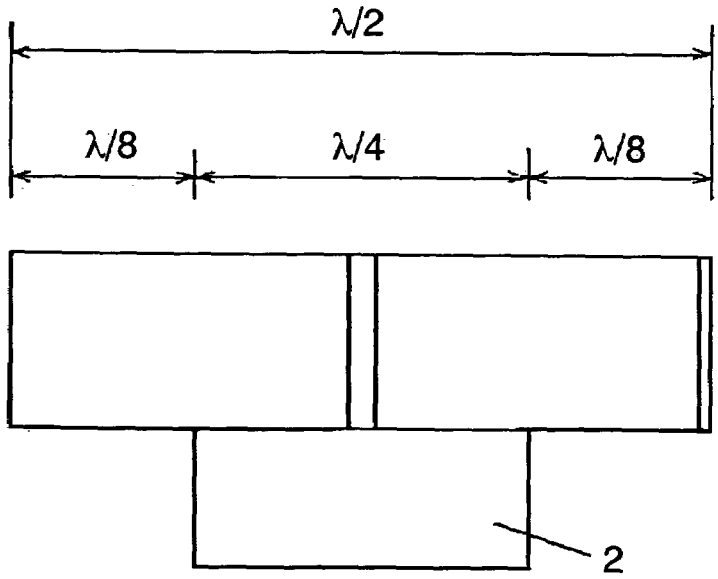
FIG. 11B is a side view of the antenna device in accordance with exemplary embodiment 11.
Figure 12:
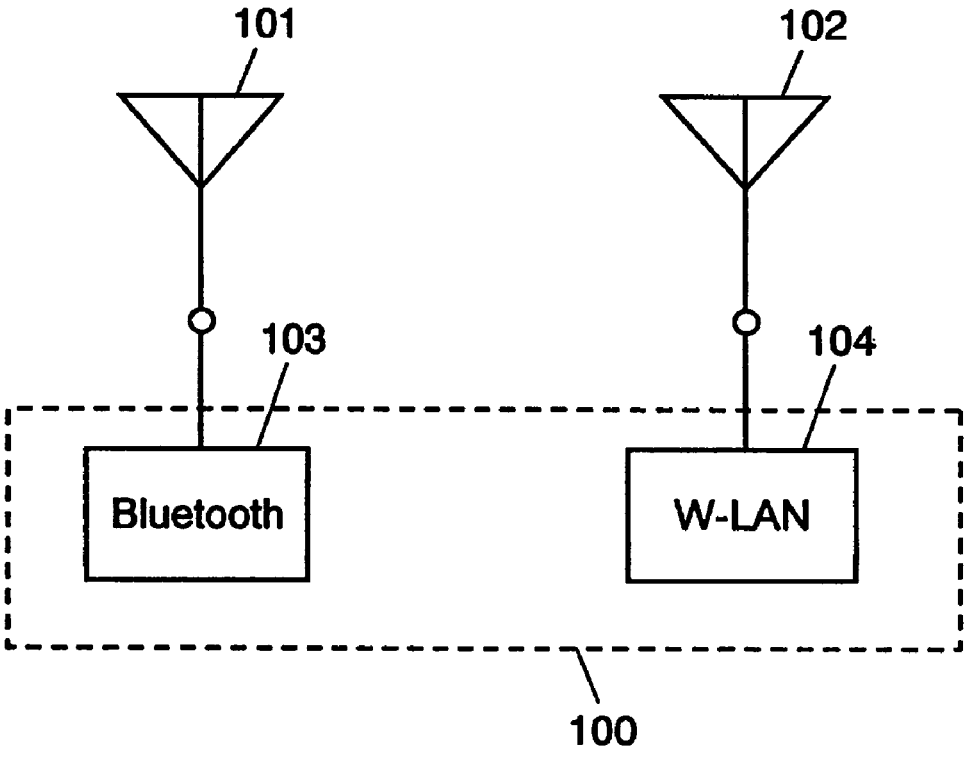
FIG. 12 PRIOR ART
FIG. 12 is a schematic diagram of a conventional antenna device.

FIG. 11A and FIG. 11B show an antenna device in accordance with exemplary embodiment 11 of the present invention. In embodiment 7, the distance between radiation plate 1 and ground plate 2 is extended by providing radiation plate 1 with a projecting cross section. In embodiment 11, however, the distance between radiation plate 1 and ground plate 2 is extended by providing ground plate 2 with a recessed cross section. Either structure can realize a SIR structure, so that the antenna device can advantageously be downsized similarly to embodiment 6.

The antenna device of the present invention has one of the following radiation plates:

an elliptic radiation plate where electric length of each of the major axis and the minor axis is substantially ½ wavelength of a desired frequency; and a radiation plate having a quadrangular shape except a regularly polygonal shape in which electric length from one peripheral point to the other peripheral point on the first straight line group is substantially ½ wavelength. Here, the first straight line group connects each power supply port to the midpoint of the radiation plate. Two power supply ports having different resonant frequency between which isolation is secured can be realized in one antenna device.

The antenna device of the present invention has power supply ports at ends of the radiation plate. Disposing the power supply ports in the outer periphery of the radiation plate facilitates manufacturing of the antenna device and mounting of it to a substrate.

The antenna device of the present invention has power supply ports on the first straight line group that connects arbitrary points at the ends of the radiation plate to the midpoint of the radiation plate. Disposing power supply sections inside the periphery of the radiation plate allows matching of the power supply ports.

In the antenna device of the present invention, respective power supply ports are used for communications of different systems. The isolation between the ports is secured, so that a shared apparatus for branching signals of respective systems need not be provided just under the antenna and hence cost and mounting space required for the shared apparatus can be reduced. In a portable terminal simultaneously using W-LAN and Bluetooth, both systems use the same frequency, so that a filter shared apparatus cannot divide signals of both systems. Two antennas must be therefore prepared and separated from each other at a certain interval to secure the isolation between the antennas. When the antenna device of the present invention is used, however, the required performance can be realized by one antenna device. As a result, cost required for the antenna is reduced and the terminal can be downsized.

In the antenna device of the present invention, the first power supply port is used for communications of the first system, and the second and third power supply ports are used for diversity type communications of the second system. A diversity antenna and the shared apparatus can be integrated, and the portable terminal can be downsized.

In the antenna device of the present invention, the first power supply port is used for communications of the first system, and second and third power supply ports are used for transmission and reception of the second system. A shared apparatus for dividing signals of the systems and a shared apparatus for dividing transmitted signals and received signals can be integrated. A multifunction-capable portable terminal can be downsized.

The present invention can provide one antenna with two or more isolated power supply ports, and realize the downsizing of the antenna device.

INDUSTRIAL APPLICABILITY

The present invention relates to an antenna device used mainly for mobile communications. One antenna can have two or more isolated power supply ports, and the antenna device can be downsized.

REFERENCE NUMERALS

1 Radiation plate
2 Ground plate
3 First power supply port
4 Second power supply port
5 First substrate
6 Slit
7 First resonance current
8 Second resonance current
9 First straight line as first straight line group
10 Second straight line as first straight line group
11 Third straight line as second straight line group
12 Fourth straight line as second straight line group
13 Fifth straight line as second straight line group
14 Sixth straight line as second straight line group
15 First line width
16 Second line width
17 Second substrate
18 Boundary line between first and second substrates
24 Gap
25 Inter-digital structure
26 Third power supply port
27 Notch
28 First reactance element
29 Second reactance element

The invention claimed is:

1. An antenna device comprising:

a ground plate;

a radiation plate faced to the ground plate; and a plurality of power supply ports in a region having zero electric potential on the radiation plate, wherein the radiation plate has four slits axisymmetric with respect to a first straight line group, the first straight line group connecting each of the power supply ports to a midpoint of the radiation plate, and two sides of each of the slits substantially contact with a second straight line group, the second straight line group intersecting the first straight line group at right angles at arbitrary points between ends of the radiation plate and the midpoint of the radiation plate.

2. An antenna device comprising:

a ground plate;

a radiation plate faced to the ground plate; and a plurality of power supply ports in a region having zero electric potential on the radiation plate, wherein the radiation plate has four slits axisymmetric with respect to a first straight line group, the first straight line group connecting each of the power supply ports to a midpoint of the radiation plate, two sides of each of the slits substantially contact with a second straight line group, the second straight line group intersecting the first straight line group at right angles at arbitrary points between ends of the radiation plate and the midpoint of the radiation plate, and a shape of the radiation plate is symmetric with respect to the midpoint of the radiation plate.

3. An antenna device according to claim 1, wherein the radiation plate is one of following radiation plates:

an elliptic radiation plate where electric length of each of a major axis and a minor axis is substantially ½ wavelength of a desired frequency; and a radiation plate having a quadrangular shape except for a regularly polygonal shape, an electric length from one peripheral point to another peripheral point on the first straight line group being substantially ½ wavelength in the radiation plate.

4. An antenna device according to claim 2, wherein the radiation plate is one of following radiation plates:

a circular radiation plate having a diameter of substantially ½ wavelength in electric length; and a regularly polygonal radiation plate in which electric length from one peripheral point to another peripheral point on the first straight line group is substantially ½ wavelength.

5. An antenna device according to claim 3, wherein two sides of each of the slits substantially contact with the second straight line group, the second straight line group intersecting the first straight line group at right angles at points substantially ⅛ wavelength in electric length away from a periphery of the radiation plate on the first straight line group.

6. An antenna device according to claim 1, wherein the power supply ports are disposed at ends of the radiation plate.

7. An antenna device according to claim 1, wherein the power supply ports are disposed on the first straight line group which connects arbitrary points of ends of the radiation plate to the midpoint of the radiation plate.

8. An antenna device according to claim 1, wherein the power supply ports are coupled to the radiation plate via gaps.

9. An antenna device according to claim 8, wherein the radiation plate and one of the power supply ports have parts with one of the gaps therebetween, the parts having an inter-digital structure.

10. An antenna device according to claim 1, wherein a third one of the power supply ports is disposed at the midpoint of the radiation plate.

11. An antenna device according to claim 1, wherein a resonant frequency in one of the power supply ports disposed at the midpoint of the radiation plate is different from a resonant frequency in another of the power supply ports.

12. An antenna device according to claim 1, wherein a distance between the radiation plate and the ground plate varies from an end of the radiation plate to the midpoint of the radiation plate on the first straight line group, and the distance between the radiation plate and the ground plate at the midpoint of the radiation plate is larger than that at a periphery of the radiation plate.

13. An antenna device according to claim 12, the distance between the radiation plate and the ground plate varies at a point substantially ⅛ wavelength in electric length away from the periphery of the radiation plate on the first straight line group.

14. An antenna device according to claim 3, further comprising a substrate made of dielectric material, magnetic material, or a mixture of the dielectric material and the magnetic material located between the radiation plate and the ground plate, wherein a value derived by dividing relative magnetic permeability of the substrate by relative dielectric constant of the substrate varies at an arbitrary point between an end of the radiation plate and the midpoint of the radiation plate on the first straight line group, and a value derived by dividing relative magnetic permeability of the substrate by relative dielectric constant of the substrate in a region close to the midpoint of the radiation plate is larger than a value derived by dividing relative magnetic permeability of the substrate by relative dielectric constant of the substrate in a region close to the end of the radiation plate on the first straight line group.

15. An antenna device according to claim 3, further comprising a substrate made of dielectric material magnetic material, or a mixture of the dielectric material and the magnetic material located between the radiation plate and the ground plate, wherein a value derived by dividing relative magnetic permeability of the substrate by relative dielectric constant of the substrate is large at a point substantially ⅛ wavelength in electric length away from a periphery of the radiation plate on the first straight line group.

16. An antenna device according to claim 1, wherein a plurality of notches are disposed at arbitrary positions at a periphery of the radiation plate axisymmetric with respect to the first straight line group.

17. An antenna device according to claim 1, wherein each of the power supply ports comprises a conductive wire, and the conductive wire forms an arbitrary angle with respect to the ground plate.

18. An antenna device according to claim 1, further comprising a plurality of reactance elements each having an opening tip, the reactive elements being located at respective positions symmetric to positions of the power supply ports with respect to a point, the point being one of a midpoint of a substantially circular radiation plate and an intersection point of diagonal lines of a substantially regularly polygonal radiation plate.

19. An antenna device according to claim 18, wherein isolation between the power supply ports is adjusted by cutting a periphery of tips of the reactance elements having the opening tips.

20. An antenna device according to claim 18, wherein the opened ends of the reactance elements are connected to the ground plate.

21. An antenna device according to claim 1, wherein each of the power supply ports is for diversity type communications.

22. An antenna device according to claim 1, wherein each of the power supply ports is for communications of a different system.

23. An antenna device according to claim 10, wherein a first of the power supply ports is for communications of a first system, and a second of the power supply ports and the third power supply port are for diversity type communications of a second system.

24. An antenna device according to claim 10, wherein a first of the power supply ports is for communications of a first system, and a second of the power supply ports and the third power supply port are for transmission and reception of a second system.

25. An antenna device according to claim 4, wherein two sides of each of the slits substantially contact with the second straight line group, the second straight line group intersecting the first straight line group at right angles at points substantially ⅛ wavelength in electric length away from a periphery of the radiation plate on the first straight line group.

26. An antenna device according to claim 2, wherein the power supply ports are disposed at ends of the radiation plate.

27. An antenna device according to claim 2, wherein the power supply ports are disposed on the first straight line group which connects arbitrary points of ends of the radiation plate to the midpoint of the radiation plate.

28. An antenna device according to claim 2, wherein the power supply ports are coupled to the radiation plate via gaps.

29. An antenna device according to claim 2, wherein a third one of the power supply ports is disposed at the midpoint of the radiation plate.

30. An antenna device according to claim 2, wherein a resonant frequency in one of the power supply ports disposed at the midpoint of the radiation plate is different from a resonant frequency in another of the power supply ports.

31. An antenna device according to claim 2, wherein a distance between the radiation plate and the ground plate varies from an end of the radiation plate to the midpoint of the radiation plate on the first straight line group, and the distance between the radiation plate and the ground plate at the midpoint of the radiation plate is larger than that at a periphery of the radiation plate.

32. An antenna device according to claim 4, further comprising a substrate made of dielectric material, magnetic material, or a mixture of the dielectric material and the magnetic material located between the radiation plate and the ground plate, wherein a value derived by dividing relative magnetic permeability of the substrate by relative dielectric constant of the substrate varies at an arbitrary point between an end of the radiation plate and the midpoint of the radiation plate on the first straight line group, and a value derived by dividing relative magnetic permeability of the substrate by relative dielectric constant of the substrate in a region close to the midpoint of the radiation plate is larger than a value derived by dividing relative magnetic permeability of the substrate by relative dielectric constant of the substrate in a region close to the end of the radiation plate on the first straight line group.

33. An antenna device according to claim 12, further comprising a substrate made of dielectric material, magnetic material, or a mixture of the dielectric material and the magnetic material located between the radiation plate and the ground plate, wherein a value derived by dividing relative magnetic permeability of the substrate by relative dielectric constant of the substrate varies at an arbitrary point between an end of the radiation plate and the midpoint of the radiations plate on the first straight line group, and a value derived by dividing relative magnetic permeability of the substrate by relative dielectric constant of the substrate in a region close to the midpoint of the radiation plate is larger than a value derived by dividing relative magnetic permeability of the substrate by relative dielectric constant of the substrate in a region close to the end of the radiation plate on the first straight line group.

34. An antenna device according to claim 4, further comprising a substrate made of dielectric material, magnetic material, or a mixture of the dielectric material and the magnetic material located between the radiation plate and the ground plate, wherein a value derived by dividing relative magnetic permeability of the substrate by relative dielectric constant of the substrate is large at a point substantially ⅛ wavelength in electric length away from a periphery of the radiation plate on the first straight line group.

35. An antenna device according to claim 12, further comprising a substrate made of dielectric material magnetic material, or a mixture of the dielectric material and the magnetic material located between the radiation plate and the ground plate, wherein a value derived by dividing relative magnetic permeability of the substrate by relative dielectric constant of the substrate is large at a point substantially ⅛ wavelength in electric length away from the periphery of the radiation plate on the first straight line group.

36. An antenna device according to claim 2, wherein a plurality of notches are disposed at arbitrary positions at a periphery of the radiation plate axisymmetric with respect to the first straight line group.

37. An antenna device according to claim 2, wherein each of the power supply ports comprises a conductive wire, and the conductive wire forms an arbitrary angle with respect to the ground plate.

38. An antenna device according to claim 2, further comprising a plurality of reactance elements each having an opening tip, the reactive elements being located at respective positions symmetric to positions of the power supply ports with respect to a point, the point being one of a midpoint of a substantially circular radiation plate and an intersection point of diagonal lines of a substantially regularly polygonal radiation plate.

39. An antenna device according to claim 2, wherein each of the power supply ports is for diversity type communications.

40. An antenna device according to claim 2, wherein each of the power supply ports is for communications of a different system.

* * * * *